US009683721B2

(12) United States Patent
Clark et al.

(10) Patent No.: US 9,683,721 B2
(45) Date of Patent: Jun. 20, 2017

(54) LIGHTING SYSTEM WITH ANGLED LED ARRAYS

(71) Applicant: FINELITE INC., Union City, CA (US)

(72) Inventors: Walter Blue Clark, Palo Alto, CA (US); David Daoud Aziz, Pleasanton, CA (US); Arlan R. Santos, San Jose, CA (US); Aaron Matthew Smith, Fremont, CA (US)

(73) Assignee: FINELITE INC., Union City, CA (US)

( * ) Notice: Subject to any disclaimer, the term of this patent is extended or adjusted under 35 U.S.C. 154(b) by 0 days.

(21) Appl. No.: 14/999,775

(22) Filed: Jun. 24, 2016

(65) Prior Publication Data

US 2016/0356459 A1 Dec. 8, 2016

Related U.S. Application Data

(63) Continuation-in-part of application No. 14/121,218, filed on Aug. 12, 2014, now Pat. No. 9,404,646.

(60) Provisional application No. 61/959,187, filed on Aug. 19, 2013.

(51) Int. Cl.

| | |
|---|---|
| ***F21V 14/02*** | (2006.01) |
| ***F21V 23/00*** | (2015.01) |
| ***F21V 3/04*** | (2006.01) |
| ***F21V 15/01*** | (2006.01) |
| ***F21S 8/06*** | (2006.01) |
| ***F21V 19/02*** | (2006.01) |
| ***F21V 21/14*** | (2006.01) |
| *F21V 3/00* | (2015.01) |
| *F21Y 103/10* | (2016.01) |
| *F21Y 115/10* | (2016.01) |

(52) U.S. Cl.

CPC ..... *F21V 14/02* (2013.01); *F21S 8/06* (2013.01); *F21V 3/049* (2013.01); *F21V 15/01* (2013.01); *F21V 19/02* (2013.01); *F21V 21/14* (2013.01); *F21V 23/003* (2013.01); *F21V 3/00* (2013.01); *F21Y 2103/10* (2016.08); *F21Y 2115/10* (2016.08)

(58) Field of Classification Search

CPC ..... F21V 14/02; F21V 3/049; F21V 15/01; F21V 23/003

See application file for complete search history.

(56) References Cited

U.S. PATENT DOCUMENTS

2007/0064425 A1* 3/2007 Frecska ..... F21S 8/04 362/253

* cited by examiner

*Primary Examiner* — Mary Ellen Bowman

(74) *Attorney, Agent, or Firm* — James A. Garvey, Jr.; JAG Patent Services LLC

(57) ABSTRACT

A lighting system with extended arrays of LED light engines is disclosed. The extended arrays of LED light engines are coupled to bent, curved, contoured or angled support surfaces within a housing structure, coupled to bent, curved, contoured or angled surfaces of the housing structure or a combination thereof. Preferably, the extended arrays of LED light engines emit both upward and downward lighting through diffuse surfaces of the housing structure. In some embodiments of the invention the positions and/or angles of light emitting surfaces of extended arrays of LED light engines are adjustable within the housing structure.

12 Claims, 4 Drawing Sheets

LIGHTING SYSTEM WITH ANGLED LED ARRAYS

RELATED APPLICATION

This application is a continuation-in-part of co-pending U.S. patent application Ser. No. 14/121,218, filed on Aug. 12, 2014, and titled "LIGHTING SYSTEM WITH ANGLED LED ARRAYS", which claims priority under 35 U.S.C. §119(e) from the U.S. provisional patent application Ser. No. 61/959,187, filed on Aug. 19, 2013, and titled "LIGHTING DEVICE WITH ASYMMETRIC LED CONFIGURATION." The U.S. patent application Ser. No. 14/121,218, filed on Aug. 12, 2014, and titled "LIGHTING SYSTEM WITH ANGLED LED ARRAYS" and the provisional patent application Ser. No. 61/959,187, filed on Aug. 19, 2013, and titled "LIGHTING DEVICE WITH ASYMMETRIC LED CONFIGURATION" is both hereby incorporated by reference.

FIELD OF THE INVENTION

This invention relates to lighting systems. More specifically, this invention relates to Light Emitting Diode (LED) devices and systems.

BACKGROUND OF THE INVENTION

A light-emitting diode (LED) is a semiconductor diode that emits light when an electrical current is applied in the forward direction of the device, such as in a simple LED circuit.

The device is fabricated from layers of silicon and seeded with atoms of phosphorus, germanium, arsenic or other rare-earth elements. The layers of the device are called the die and the junction between the materials is where the light is generated. The electricity enters from one side of the die and exits out the other. As the current passes through the LED device, the materials that makes up the junction react and light is emitted.

LEDs are widely used as indicator lights on electronic devices and increasingly in higher power applications such as flashlights and area lighting. A LED is usually a small area (less than 1 $mm^2$) light source, often with optics added to the chip to shape its radiation pattern and assist in reflection. The color of the emitted light depends on the composition and condition of the semiconducting material used, and can be infrared, visible, or ultraviolet. The glow, color and wash of a lighting fixture with sets of LED arrays is sensitive to the angles of the LED arrays with respect to one and other.

SUMMARY OF THE INVENTION

The present invention is directed to a lighting system with angled extended arrays of LED light engines. Angled, herein, means that light emitting surfaces of the extended arrays of LED light engines are positioned at angles with respect to each other with a housing structure that form a lighting cavity. The extended arrays of LED light engines are coupled to bent, curved, contoured or angled support surfaces within the housing structure, coupled to bent, curved, contoured or angled surfaces of the housing structure or a combination thereof.

The housing structure includes, for example, opaque surfaces and diffuse surfaces (lenses). Preferably, the extended arrays of LED light engines emit both upward and downward lighting through the diffuse surfaces of the housing structure.

The lighting system of the present invention includes one or more LED driver circuits in electrical communication with the extended arrays of LED light engines to provide dimming control of the upward and the downward lighting. In further embodiment of the invention the lighting system includes independently operable LED drivers in electrical communication with selected sets of the extended arrays of the LED light engines to provide independently controllable dimming of the upward and the downward lighting.

In accordance with the invention, the support surfaces within the housing structure of the lighting system with the extended arrays of LED light engines coupled thereto are adjustable. In some embodiments of the invention, angles of the support surfaces within the housing structure of the lighting system are adjustable, such that the angles of the light emitting surfaces of extended arrays of LED light engines are also adjustable with respect to each other.

DETAILED DESCRIPTION OF THE INVENTION

Figure 1:
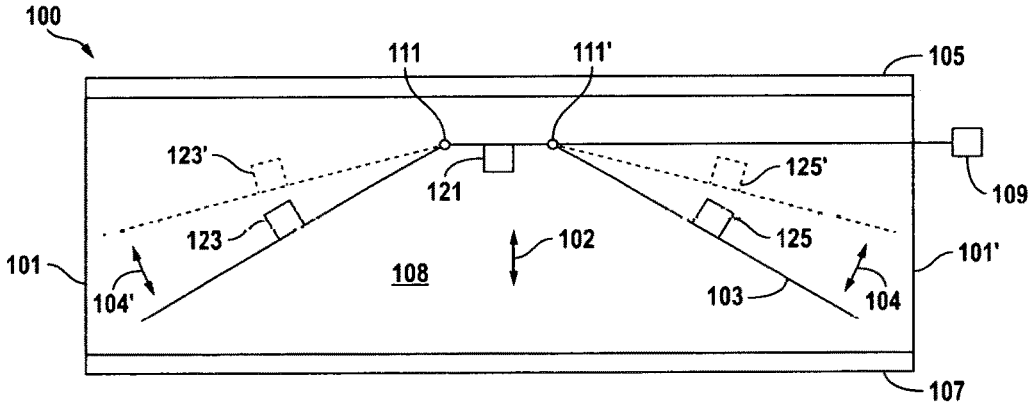
FIG. 1 shows a schematic representation of a lighting system with extended arrays of LED light engines positioned at angles relative to each other on an adjustably angled support structure, in accordance with the embodiments of the invention.

FIG. 1 shows a lighting system 100 that includes a housing structure that forms a lighting cavity 108. The housing structure includes opaque side surfaces 101 and 101' and top 105 and bottom 107 diffuser lenses. The lighting system 100 also includes support structure 103 that is bent, curved, contoured or angled. Extended arrays of LED light engines 123 and 125 are couple to top surfaces of the support structure 103. An extended array of LED light engines 121 is also coupled to a center bottom surface of the support structure 103.

The lighting system 100 provides upward and downward lighting through the top 105 and bottom 107 diffuser lenses. The extended arrays of LED light engines 121, 123 and 125 are all powered by the same LED driver (not shown) or are alternatively powered by one or more independently controllable LED drivers to provide independent upward and downward and/or sideways dimming from the extended arrays of LED light engines 121, 123 and 125.

In accordance with the embodiments of the invention the angles or positions of extended arrays of LED light engines 121 and 123 are moveable or adjustable to new positions 123' and 125' by, for example, moving portions of the support structure 103 through one or more hinge features 111 and 111', as indicated by the arrows 102, 104 and 104'. The angle or positions of the portions of the support structure 103 are controlled manually or through a control device 109 that is in electrical or wireless communication with servo-motors or other mechanisms that drive the portion of the support structure 103 to move the extended arrays of LED light engines 121 and 123 to one or more selectable positions.

Figure 2:
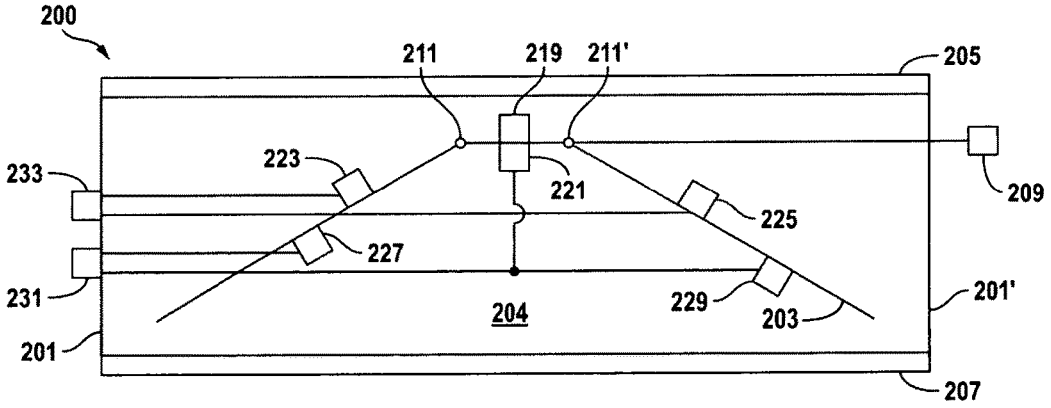
FIG. 2 shows a schematic representation of a lighting system with extended arrays of LED light engines with LED drivers for independently controlling dimming of upward and downward lighting, in accordance with the embodiments of the invention.

Referring now to FIG. 2, a lighting system 200 includes a housing structure that form a lighting cavity 204. The housing structure includes opaque side walls 210 and 201' and top 205 and bottom 207 diffuser lenses. The lighting system 200 also includes a support structure 203 that is bent, curved, contoured or angled. On opposed top surfaces of the support structure 203 extended arrays of LED light engines 223 and 225 are mounted. Also, on opposed bottom surfaces of the support structure 203 extended arrays of LED light engines 227 and 229 are mounted. Further, on center top and bottom surfaces of the support structure 203 additional extended arrays of LED light engines 221 and 219 are also mounted.

The extended arrays of LED light engines 219, 221, 223, 225, 227 and 229 are all powered by the same LED driver circuit or are alternatively powered by one or more independently controllable LED driver circuits 231 and 233 to provide independent upward and downward and/or sideways dimming from the LED light engines 219, 221, 223, 225, 227 and 229. For example, LED light engines 221, 227 and 229 are powered by a downward dimming LED driver circuit 231 and the LED light engines 219, 223 and 225 are powered by an upward LED dimming driver circuit 233.

In accordance with the embodiments of the invention the angles or positions of portions of the support structure 203 are adjustable through one or more hinge features 211 and 211' as described above with reference to FIG. 1. The angles or positions of the portions of the support structure 203 are controlled manually or by a control device 209 that is in electrical or wireless communication with servo-motors or other mechanisms that drive the portions of the support structure 203 to move to one or more selectable positions.

Figure 3A:
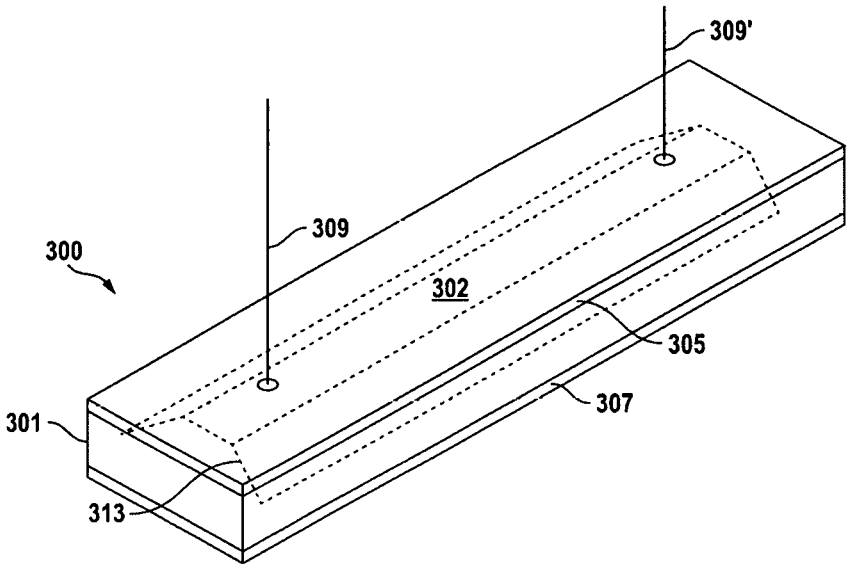
FIG. 3A shows lighting system with an angled support structure housed within a lighting cavity having opposed opaque side walls, opposed top and bottom diffuser lenses and mounting features, in accordance with the embodiments of the invention.

FIG. 3A shows a linear or extended lighting fixture 300 that includes a bent, curved, contoured or angled support structure 313 housed within a lighting cavity 302 of a housing structure. The housing structure includes opaque side walls 301, a top diffuser lens 305 and a bottom diffuser lens 307. The bent, curved, contoured or angled support structure 313 supports any number of extended arrays of LED light engines that are controlled or dimmed by the same or different LED drivers, such as described with reference to FIGS. 1-2. The lighting system 300 includes mounting features, such as cables 309 and 309', that allows the lighting system 300 to be attached to or suspended from a ceiling or wall. As described above, the bent, curved, contoured or angled support structure 331 is stationary or adjustable to move the relative positions or angles of the light emitting surfaces of the extended arrays of LED light engines attached thereto within the lighting cavity 302.

Figure 3B:
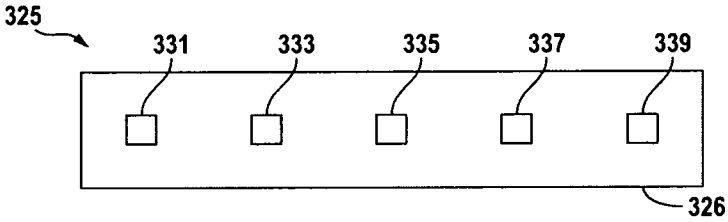
FIGS. 3B-C show schematic representations of extended arrays of LED light engines, in accordance with the embodiments of the invention.
Figure 3C:
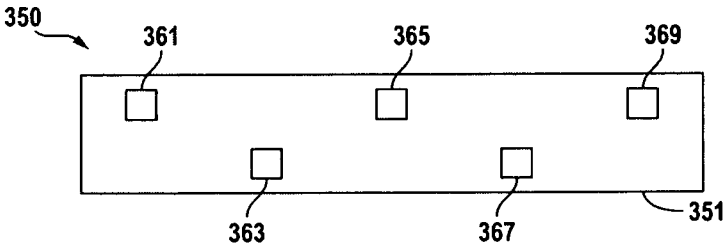

FIGS. 3B-C show schematic representations of extended arrays of LED light engines 325 and 350, in accordance with the embodiments of the invention. The extended array of LED light engines 325 includes any number of aligned LEDs 331, 333, 335, 337 and 339 that form a light emitting surface 326 that is substantially planar. The extended array of LED light engines 350 includes any number of staggered LEDs 361, 363, 365, 367 and 369 that form a light emitting surface 351 that is substantially planar. It will be clear to one skilled in the art that any number of configuration of extended arrays of LED light engines that from a substantially planar light emitting surface are within the scope of the invention.

Figure 4A:
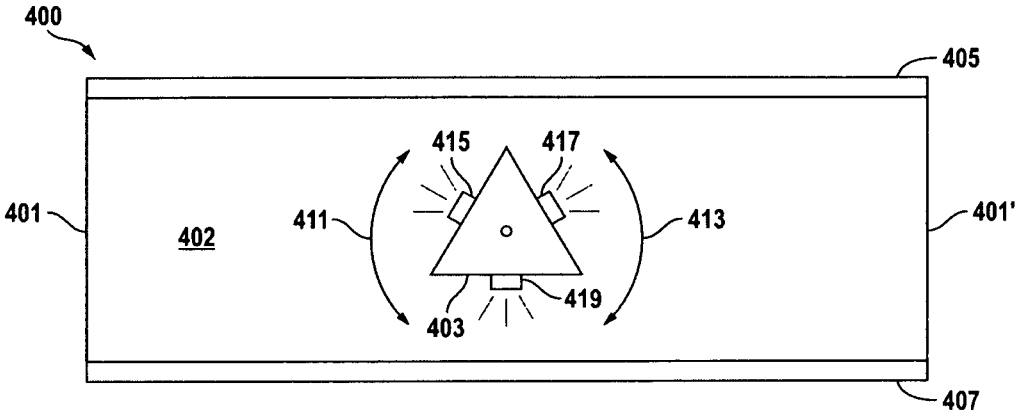
FIG. 4A shows a schematic representation of a lighting system with a movable or adjustable support and extended arrays of LED light engines coupled thereto, in accordance with the embodiments of the invention.

FIG. 4A show a lighting system 400 includes a housing structure that forms a lighting cavity 402. The housing structure includes opaque side surfaces 401 and 401' with a top 405 and bottom 407 diffuser lens. The lighting system 100 also includes support structure 403 with angled surfaces. Extended arrays of LED light engines 415, 417 and 419 are mounted, supported or otherwise coupled to the angled surfaces of the support structure 403. In accordance with this embodiment of the invention the positions of the extended arrays of LED light engines 415, 417 and 419 are moved within the lighting cavity 402 of the lighting system 400 by moving or rotating the support structure 403, as indicated by the arrows 411 and 413.

Figure 4B:
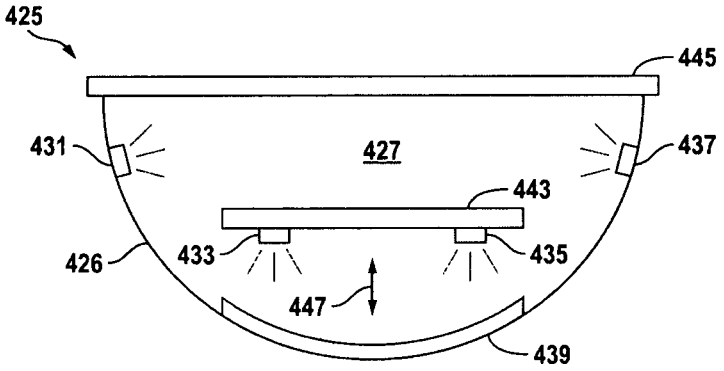
FIG. 4B shows a lighting system with a contoured housing structure, a support structure and extended arrays of LED light engines coupled to the contoured housing structure and the support structure, in accordance with the embodiments of the invention.

FIG. 4B shows a lighting system 425 that includes a housing structure that forms a lighting cavity 427 with a support structure 443 therein. The housing structure includes curved opaque side surfaces 426 with a top 445 and a bottom 439 diffuser lens. Extended arrays of LED light engines 431 and 437 are mounted, supported or otherwise couple to the curved opaque side surfaces 426 of the housing structure. Extended arrays of LED light engines 433 and 435 are also mounted, supported or otherwise couple to a surface of the support structure 433. In operation, the relative positions of the light emitting surfaces of the extended arrays of LED light engines 431 and 437 and the extended arrays of LED light engines 433 and 435 are changed or adjusted by moving the support structure 433 up or down within the lighting cavity 427, as indicated by the arrow 447.

Figure 4C:
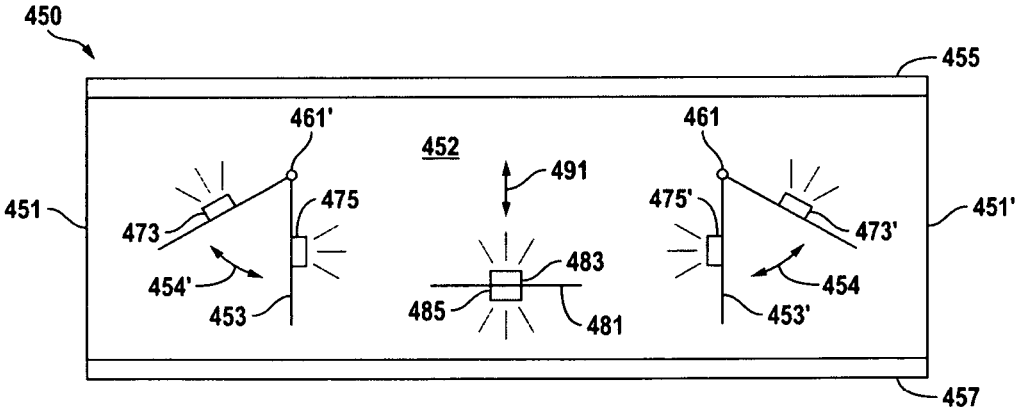
FIG. 4C shows a schematic representations of a lighting system with an alternative configuration that includes multiple angled support surfaces and extended arrays of LED light engines coupled to the angled support surfaces, in accordance with the embodiments of the invention.

FIG. 4C show a lighting system 450 includes a housing structure that forms a lighting cavity 452. The housing structure includes opaque side surfaces 451 and 451' with a top 455 and bottom 457 diffuser lens. The lighting system 450 also includes support structures 453 and 453' with angled surfaces. On the angles surfaces of the support structures 453 and 453' extended arrays of LED light engines 473, 475, 473' and 475' are mounted or supported. In accordance with this embodiment of the invention the angles or positions of the extended arrays of LED light engines 473, 475, 473' and 475' are changed within the lighting cavity 452 by moving portions of the support structures 453 and 453' through one or more hinge features 461 and 461, as indicated by the arrows 454 and 454'. The angles or positions of the portions of the support structures 453 and 453' are changed, adjusted or controlled manually or through a control device (not shown) that is in electrical or wireless communication with servo-motors or other mechanisms that move the portions of the support structure structures 453 and 453' to thereby move the extended arrays of LED light engines 473, 475, 473' and 475' to selectable positions.

Still referring to FIG. 4C, the lighting system 450 includes a support structure 481 with extended arrays of LED light engines 483 and 485 mounted or supported thereon. In operation the positions of the light emitting surfaces of the extended arrays of LED light engines 483 and 485 relative to the light emitting surfaces of the extended arrays of LED light engines 473, 475, 473' and 475' are changed by moving the support structure 481 up or down within the lighting cavity 452, as indicated by the arrow 447.

Referring generally to FIGS. 4A-C, while the lighting systems 400, 425 and 450 have been illustrated without LED driver circuits, its is understood that one or more internal or external LED driver circuit is required to power the lighting systems 400, 425 and 450. Further, while the lighting systems 400, 425 and 450 have been illustrated without a mechanism for moving or changing positions or angles of light emitting surfaces of the extended arrays of LED light engines within lighting cavities 402, 427 and 452, it is understood any number of suitable mechanism are within the scope of the invention.

Figure 5A:
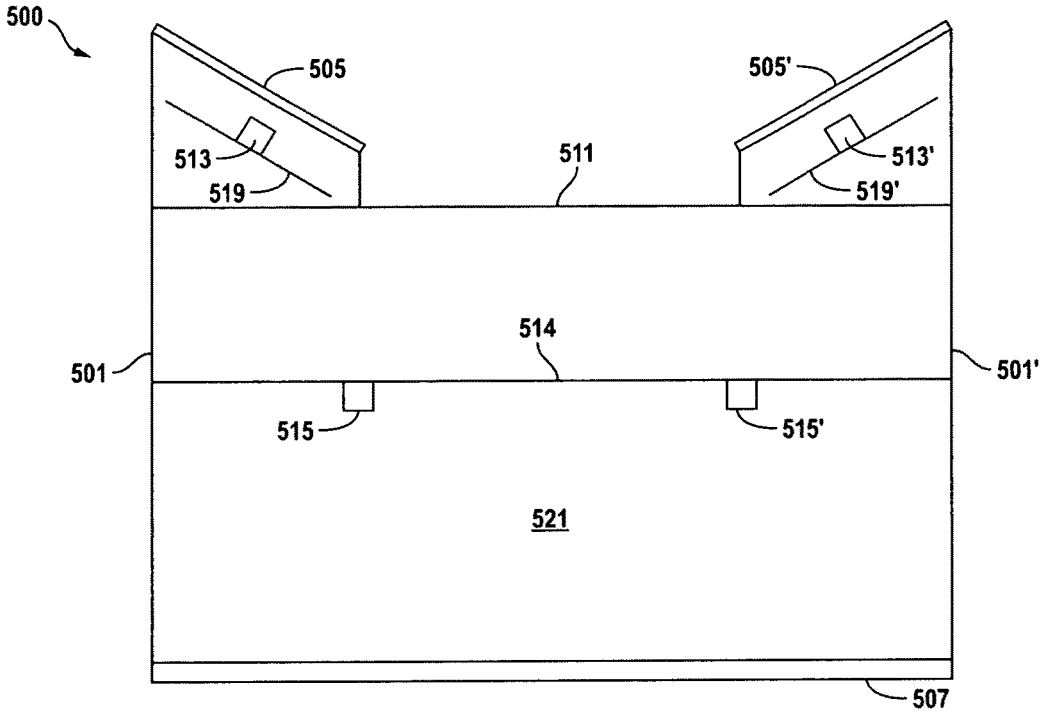
FIG. 5A shows a schematic representation of a lighting system with acute and angled supports with extended arrays of LED light engines coupled thereto, in accordance with the embodiments of the invention.

FIG. 5A shows a schematic representation of a lighting system 500 with acute and angled supports 519 and 519' with extended arrays of LED light engines 513 and 513' coupled thereto. The lighting system 500, also includes diffuser lens 505 and 505' positioned in front of the light emitting surfaces of the extended arrays of LED light engines 513 and 513'. The lighting system 500 preferably includes a housing structure with opaque side walls 501 and 501'. The lighting system also preferably includes a bottom diffuser lens 507 forming an optical cavity 521 between a top support structure or top diffuser lens 511 and the opaque side walls 501 and 501'. Within the optical cavity 521 there is an internal support structure 514 with LED light engines 515 and 515' attached to a bottom surface of the internal support structure 514. In operation, the acute and angled LED light engines 513 and 513' emit light in an upward, angle and acute direction and the LED light engines 515 and 515' emit light a downward direction. As described above, each of the LED light engines 513, 513', 515 and 515' or any combination of the LED light engines 513, 513', 515 and 515 are configured to be independently controlled.

Figure 5B:
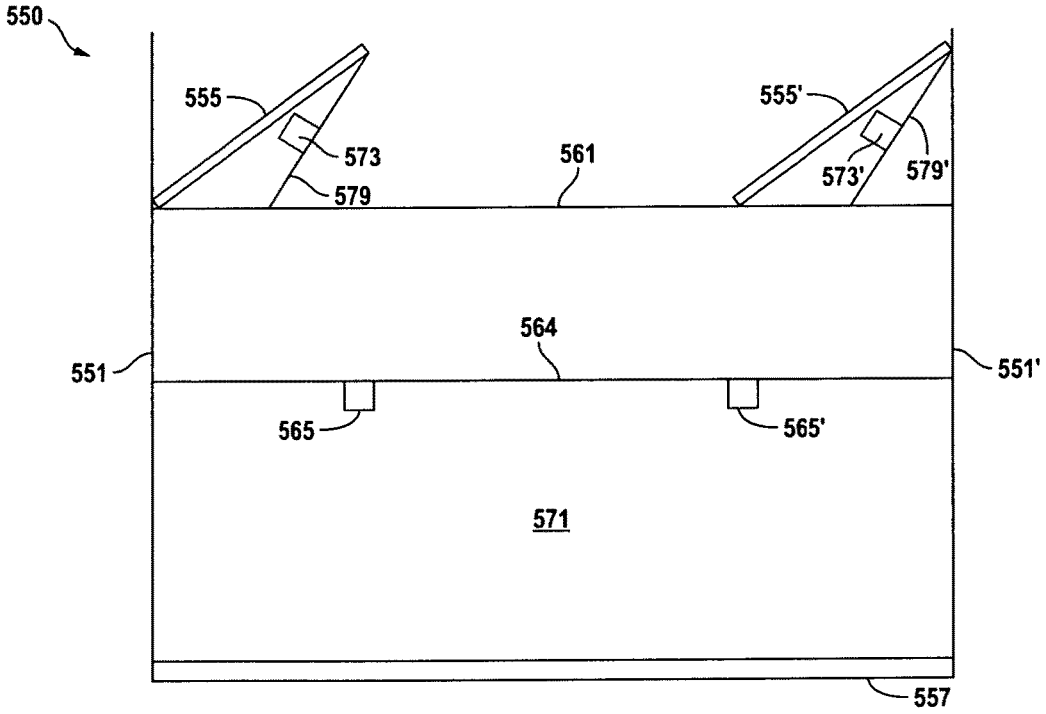
FIG. 5B shows a schematic representation of a lighting system with parallel and angled supports with extended arrays of LED light engines coupled thereto, in accordance with the embodiments of the invention.

FIG. 5B shows a schematic representation of a lighting system 550 with parallel and angled supports 579 and 579' with extended arrays of LED light engines 573 and 573' coupled thereto. The lighting system 550, also includes diffuser lens 555 and 555' positioned in front of the light emitting surfaces of the extended arrays of LED light engines 573 and 573'. The lighting system 550 preferably includes a housing structure with opaque side walls 551 and 551'. The lighting system also preferably includes a bottom diffuser lens 557 forming an optical cavity 571 between a top support structure or top diffuser lens 561 and the opaque side walls 551 and 551'. Within the optical cavity 571 there is an internal support structure 564 with LED light engines 565 and 565' attached to a bottom surface of the internal support structure 564. In operation, the acute and angled LED light engines 573 and 573' emit light in an upward, angle and parallel direction and the LED light engines 565 and 565' emit light a downward direction. As described above, each of the LED light engines 573, 573', 565 and 565' or any combination of the LED light engines 573, 573', 565 and 565 are configured to be independently controlled.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. A lighting system comprising:
   a) an elongated lighting cavity formed from a housing structure with two opposed side surfaces;
   b) separate upper support structures attached to each of the two opposed side surfaces, wherein the separate upper support structures positioned within the elongated lighting cavity, wherein the separate upper support structures are angled with respect to the each of the two opposed side surfaces;
   c) a lower support structure positioned within the elongated lighting cavity and below the separate upper support structures;
   d) upper diffuse surfaces positioned juxtaposed to top surfaces of each of the separated upper support structures and a lower diffuse surface juxtaposed to a bottom surface of the lower support structure; and
   e) arrays of LED light engines attached to the top surfaces of the separate upper support structures and arrays of LED light engines attached to the bottom surface of the lower support structure.

2. The lighting system of claim 1, wherein positions the lower support structure within the elongated lighting cavity are adjustable.

3. The lighting system of claim 1, wherein angles of the upper support structures are adjustable with respect to each other.

4. The lighting system of claim 1, further comprising LED driver circuits in electrical communication with the arrays of LED light engines attached to the top surfaces of the separate upper support structures and the arrays of LED light engines attached to the bottom surface of the lower support structure to control upward and downward lighting.

5. A lighting device comprising:
   a) an elongated lighting cavity formed from a housing structure with opposed side surfaces and a diffuse top surface and a diffuse bottom surface;
   b) two separate and opposed bent, curved, contoured or angled elongated support structures positioned within the elongated lighting cavity and each being attached to one of the opposed side surfaces; and
   c) sets of arrays of LED light engines attached to each of the two separate and opposed bent, curved, contoured or angled elongated support structures, such that sets of arrays of LED light engines on the two separate and opposed bent, curved, contoured or angled elongated support structures provide upward lighting.

6. The lighting system of claim 5, further comprising a center support structure positioned within the elongated lighting cavity between the two opposed bent, curved, contoured or angled elongated support structures, the center support structure having an array of LED light engines on a bottom surface to provide downward lighting.

7. The lighting system of claim 5, further comprising independently operable LED drivers to provide independently controllable dimming of the upward and the downward lighting.

8. The lighting system of claim 5, wherein the position of the center support structure positioned within the elongated lighting cavity is adjustable.

9. A lighting system comprising:

a) an elongated lighting cavity formed from a housing structure with opposed and opaque side surfaces and a diffuse top surface and a diffuse bottom surface;

b) an elongated support structure positioned within the elongated lighting cavity; and c) sets of arrays of LED light engines attached each of the opposed and opaque side surfaces of the housing structure and a bottom surface of the an elongated support structure to provide upward lighting through the diffuse top surface and downward lighting through the diffuse bottom surface, respectively.

10. The lighting system of claim 9, wherein the opposed and opaque side surfaces are curved or contoured.

11. The lighting system of claim 9, further comprising independently operable LED drivers to independently control dimming of lighting emitted through the diffuse top surface and the diffuse bottom surface of the elongated lighting cavity.

12. The lighting system of claim 9, wherein a position of the elongated support structure within the lighting cavity is adjustable.

* * * * *